US006315287B1

(12) United States Patent
Hirth et al.

(10) Patent No.: US 6,315,287 B1
(45) Date of Patent: Nov. 13, 2001

(54) DELIVERY OF A SHEET-PROCESSING PRINTING MACHINE

(75) Inventors: Roland Hirth, Römerberg (DE); Richard Mack, Kennesaw, GA (US)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/538,139

(22) Filed: Mar. 29, 2000

(30) Foreign Application Priority Data

Mar. 29, 1999 (DE) ..... 199 14 177

(51) Int. Cl.[7] ..... B65H 29/68
(52) U.S. Cl. ..... 271/182; 271/204
(58) Field of Search ..... 271/182, 183, 271/204, 205

(56) References Cited

U.S. PATENT DOCUMENTS 2,924,453 * 2/1960 Peyrebrune .
3,941,374 3/1976 Vits .
5,221,079 6/1993 Most et al. .
5,431,386 * 7/1995 Blaser ..... 271/204
5,582,400 * 12/1996 Seydel ..... 271/204 X
5,718,176 * 2/1998 Stephan ..... 271/182 X

FOREIGN PATENT DOCUMENTS 23 48 320 C3 12/1978 (DE) .
41 19 511 A1 12/1992 (DE) .
42 39 561 A1 5/1994 (DE) .
43 07 383 A1 9/1994 (DE) .
44 35 988 A1 4/1996 (DE) .
2 272 892 A 6/1994 (GB) .

* cited by examiner

*Primary Examiner*—David H. Bollinger
(74) *Attorney, Agent, or Firm*—Herbert L. Lerner; Laurence A. Greenberg; Werner H. Stemer

(57) ABSTRACT

A delivery of a sheet-processing printing machine having operationally revolving grippers for transferring processed sheets to a sheet brake in a conveying direction includes sheet guides for acting upon lateral borders of the sheets, as viewed in the conveying direction, and for guiding the sheets as they are transferred to the sheet brake.

8 Claims, 3 Drawing Sheets

DELIVERY OF A SHEET-PROCESSING PRINTING MACHINE

BACKGROUND OF THE INVENTION

Field of the Invention

The invention relates to a delivery of a sheet-processing printing machine having grippers which revolve during operation and transfer the processed sheets in a conveying direction to a sheet brake.

The published German Patent Document DE 44 35 988 A1 discloses suction devices revolving at a variable speed, which grip the sheets, respectively, transported via the revolving grippers, in a region of the sheets that is adjacent to the trailing edge, at an instant of time at which the speed of the suction devices coincides with the processing speed of the printing machine. Thereafter, the grippers release the respective sheet gripped by the suction devices and the suction devices are braked to a reduced revolving speed at which they, for their part, finally release the sheets for the purpose of forming a sheet pile.

This process takes place without disruption only when, in particular, assurance is provided that the region of a respective sheet that is to be gripped by the suction devices and is adjacent to the trailing edge of the sheets is guided as far as possible so that it does not flutter about, in particular, at that instant of time at which the suction devices, respectively, are to grip such a region.

Flutter-free guidance of printed sheets in a delivery is also an important precondition for achieving satisfactory printed products with respect to avoiding the smearing or smudging of a printed image applied to the sheets. Efforts to satisfy this precondition can be gathered from the prior art, in particular, from the published German Patent Document DE 42 39 561 A1. This document proposes to avoid whiplash-like movements of the trailing sheet edge by providing a guide surface disposed parallel to the path along which the grippers transport a respective sheet, with positive guidance of the leading edge of the respective sheet, as viewed in the conveying direction, and which can be moved continuously in the conveying direction of the grippers at sheet-conveying speed, the directing surface being formed by a suction-belt arrangement which secures a region of a respective sheet that is adjacent to the trailing edge of the sheet, the region being attached by suction in the process, with the result that a respective sheet is subjected to positive guidance not just in the region of the leading edge thereof, but more-or-less in the region of the trailing edge thereof, as well.

SUMMARY OF THE INVENTION

It is accordingly an object of the invention to provide a delivery of a sheet-processing printing machine of the type mentioned in the introduction hereto so as to ensure that the sheets are received reliably by a sheet brake.

With the foregoing and other objects in view, there is provided, in accordance with the invention, a delivery of a sheet-processing printing machine having operationally revolving grippers for transferring processed sheets to a sheet brake in a conveying direction, comprising sheet guides for acting upon lateral borders of the sheets, as viewed in the conveying direction, and for guiding the sheets as they are transferred to the sheet brake.

In accordance with another feature of the invention, the sheet guides are formed with guide surfaces for supporting the lateral borders of the sheets, the lateral borders of the sheets being pressable against the guide surfaces.

In accordance with a further feature of the invention, the delivery has a pressure difference prevailing at the sheets and actionable for pressing the lateral borders of the sheets against the guide surfaces.

In accordance with an added feature of the invention, the delivery includes cyclically operatable hold-downers for pressing the lateral borders of the sheets against the guide surfaces.

In accordance with an additional feature of the invention, the guide surfaces are operationally at a standstill.

In accordance with yet another feature of the invention, the guide surfaces are formed by strands of revolving belts running in the conveying direction during operation.

In accordance with a concomitant feature of the invention, the sheet guides are adaptable to mutual spacing between the lateral borders of the sheets.

Thus, in order to achieve the objective of the invention, sheet guides are provided which act upon the lateral borders of the sheets, as viewed in the conveying direction, and guide the sheets as they are transferred to the sheet brake.

Even at relatively high processing speeds, this achieves largely smooth running of the sheets in a stretch wherein the sheets are to be gripped by the sheet brake. In particular, with the delivery constructed in the foregoing manner, it is possible specifically for a region of a respective sheet which is adjacent to the trailing edge thereof to be gripped reliably by the sheet brake. The delivery is thus suitable, in particular, for braking sheets which are printed on both sides, and thus renders superfluous the operation where the sheet brake is set so that sheets which are printed on both sides thereof are gripped by thereby within non-printed areas running in the conveying direction.

Before the sheet brake is reached, in particular, sheets which are printed on both sides thereof are usually guided, for the purpose of avoiding smearing, over an air cushion formed between the sheet and a sheet-guiding surface, the grippers passing through a gripper path that follows the course of the sheet-guiding surface. In this regard, the air cushion is preferably formed by various arrangements of blast or suction nozzles in the sheet-guiding surface so that smooth running of the sheets over the sheet-guiding surface is achieved. However, in particular, in the region of the sheet brake, the air cushion also forms a flow which, in the case of a conventional delivery, makes it difficult for the respective sheet to be positioned against braking elements of the sheet brake, for example, suction rollers, suction wheels or endless bands or belts passing over a suction box. This disadvantage is also eliminated by the construction of a delivery according to the invention.

An advantageous configuration provides for the sheet guides to be formed with guide surfaces which support the lateral borders of the sheets and against which the lateral borders of the sheets are pressable.

According to a first variation therefrom, the lateral borders of the sheets can be pressed against the guide surfaces preferably under the action of a pressure difference prevailing at the sheets, while, according to a second variation therefrom, the lateral borders of the sheets can be pressed against the guide surfaces by cyclically operated hold-downers. In the case of both variants, according to a first configuration, the guide surfaces preferably remain at a standstill, while, according to a second configuration, they are preferably formed by strands of revolving belts which run in the conveying direction during operation.

Furthermore, for all the variants and configurations, it is preferably provided that the sheet guides be adaptable to the mutual spacing between the lateral borders of the sheets.

Other features which are considered as characteristic for the invention are set forth in the appended claims.

Although the invention is illustrated and described herein as embodied in a delivery of a sheet-processing printing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

BRIEF DESCRIPTION OF THE DRAWINGS

FIG. 4*b* is a sectional view of FIG. 2 taken along the line IV—IV in the direction of the arrows, for the case wherein guide surfaces are provided on revolving belts or the like.

DESCRIPTION OF THE PREFERRED EMBODIMENTS

Figure 1:
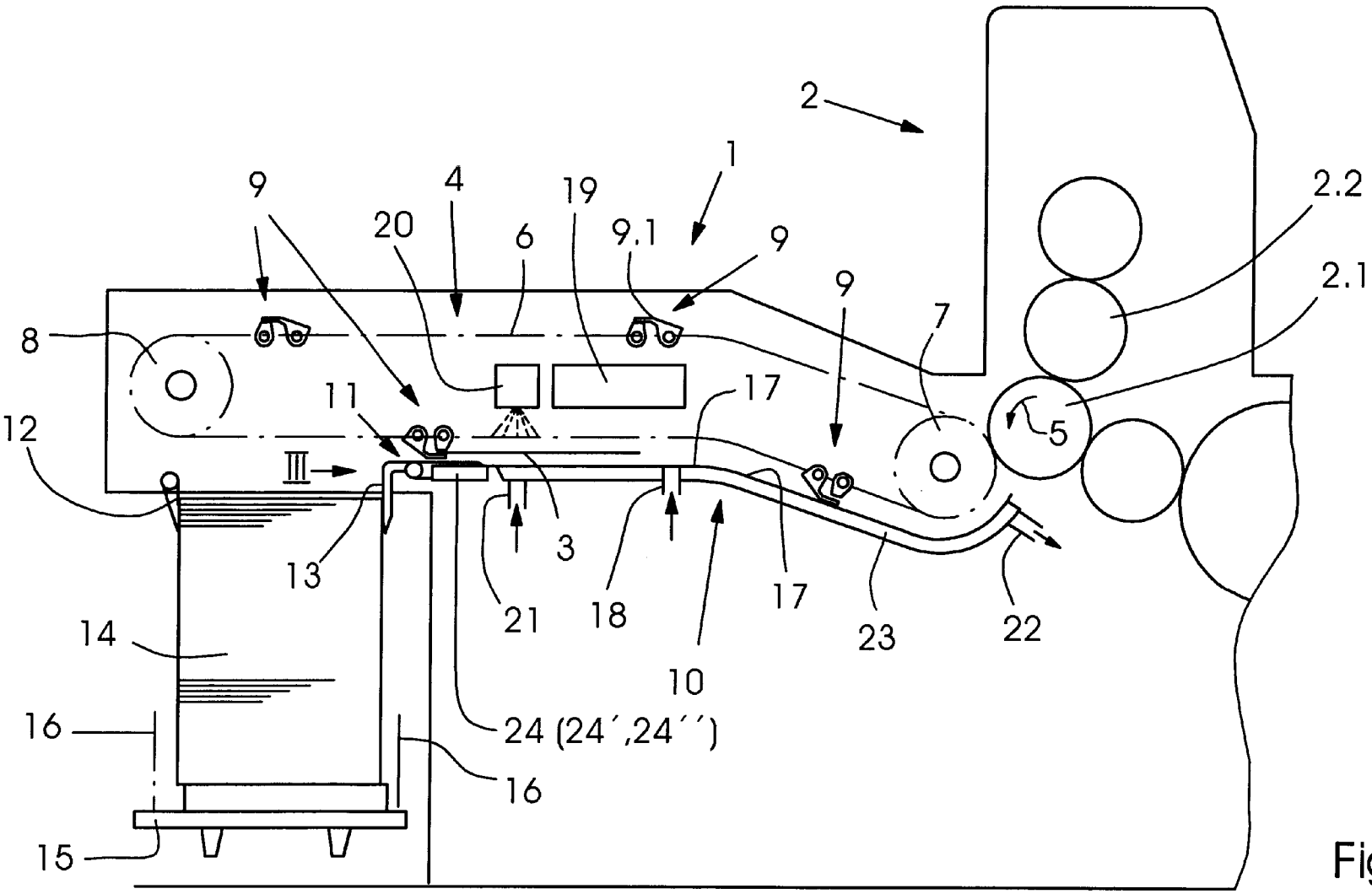
FIG. 1 is a fragmentary diagrammatic side elevational view of a sheet-processing machine, showing a section thereof which includes a delivery with a sheet brake.

Referring now to the drawings and, first, particularly to FIG. 1 thereof, there is shown a delivery 1 following a last processing station of a printing machine. Such a processing station may be a printing unit or a post-treatment unit, for example, a varnishing unit. In the example at hand, the last processing station is an offset printing unit 2 with an impression cylinder 2.1. The latter guides a respective sheet 3, in a processing direction indicated by a rotary-direction arrow 5, through a nip between the impression cylinder 2.1 and a blanket cylinder 2.2, which cooperates with the impression cylinder 2.1, and then transfers the sheet 3 to a chain conveyor 4, grippers which are arranged on the impression cylinder 2.1 and are provided for gripping the sheet 3 at a gripper margin or border at a leading end of the sheet being opened during the process. The chain conveyor 4 includes two conveying chains 6, of which, respectively, one revolves along a respective side wall of the chain delivery 1 during operation. A respective conveying chain 6 wraps around a respective one of two synchronously driven drive chain wheels 7, the axes of rotation of which are aligned with one another, and, in the example at hand, is guided over a respective deflecting chain wheel 8 that is located downline of the drive chain wheels 7, as viewed in the processing direction. Extending between the two conveying chains 6 are gripper systems 9 borne by the conveying chains, with grippers 9.1, which pass through gaps between grippers which are disposed on the impression cylinder 2.1 and thus receive a respective sheet 3, the gripper margin at the leading end of the sheet 3 being gripped in the process, immediately before the grippers disposed on the impression cylinder 2.1 are opened, transport the sheet, beyond a sheet-guiding device 10, to a sheet brake 11 and open thereat in order to transfer the sheet 3 to the sheet brake 11. The latter imparts to the sheet a depositing speed which is lower than the processing speed and releases the sheet after it has attained the depositing speed, with the result that a respective, then retarded sheet 3 finally comes into contact with front or leading-edge stops 12 and, being aligned against the latter and against rear or trailing-edge stops 13, which are located opposite the leading-edge stops, forms a sheet pile 14 together with previous and/or following sheets 3, it being possible for the sheet pile to be lowered, by a lifting mechanism, to the same extent as the pile 14 grows. Of the lifting mechanism, FIG. 1 illustrates only a platform 15, which bears the sheet pile 14, and lifting chains 16, which bear the platform and are represented in phantom, i.e., by dot-dash lines.

Along the path of the conveying chains 6 between the drive chain wheels 7, on the one hand, and the deflecting-chain wheels 8, on the other hand, the conveying chains 6 are guided by chain-guide rails, which thus determine the paths of the chain strands. In the example of FIG. 1, the sheets 3 are transported by the chain strand which is at the bottom in FIG. 1. That section of the chain path through which the chain strand runs is juxtaposed by a sheet-guiding surface 17 facing towards the chain path and formed on the sheet-guiding device 10. A carrying air cushion is preferably formed, during operation, between the sheet-guiding surface 17 and the sheet 3, respectively, guided thereover. For this purpose, the sheet-guiding device 10 is provided with blast-air nozzles which terminate in the sheet-guiding surface 17, only one nozzle thereof being illustrated in FIG. 1, as representative of all of the nozzles, symbolically in the form of a stub 18.

In order to prevent the printed sheets 3 in the pile 14 from sticking together, a dryer 19 and a spray powder device 20 are provided on the path of the sheets 3 from the drive chain wheels 7 to the sheet brake 11.

In order to avoid excessive heating of the sheet-guiding surface 17 by the dryer 19, a coolant circuit is integrated in the sheet-guiding device 10 and is indicated symbolically in FIG. 1 by an inlet stub 21 and an outlet stub 22 on a coolant tank 23 assigned to the sheet-guiding surface 17.

The chain-guide rails are not illustrated in FIG. 1. However, the course thereof is apparent in FIG. 1 from the illustrated course of the chain strands.

Figure 2:
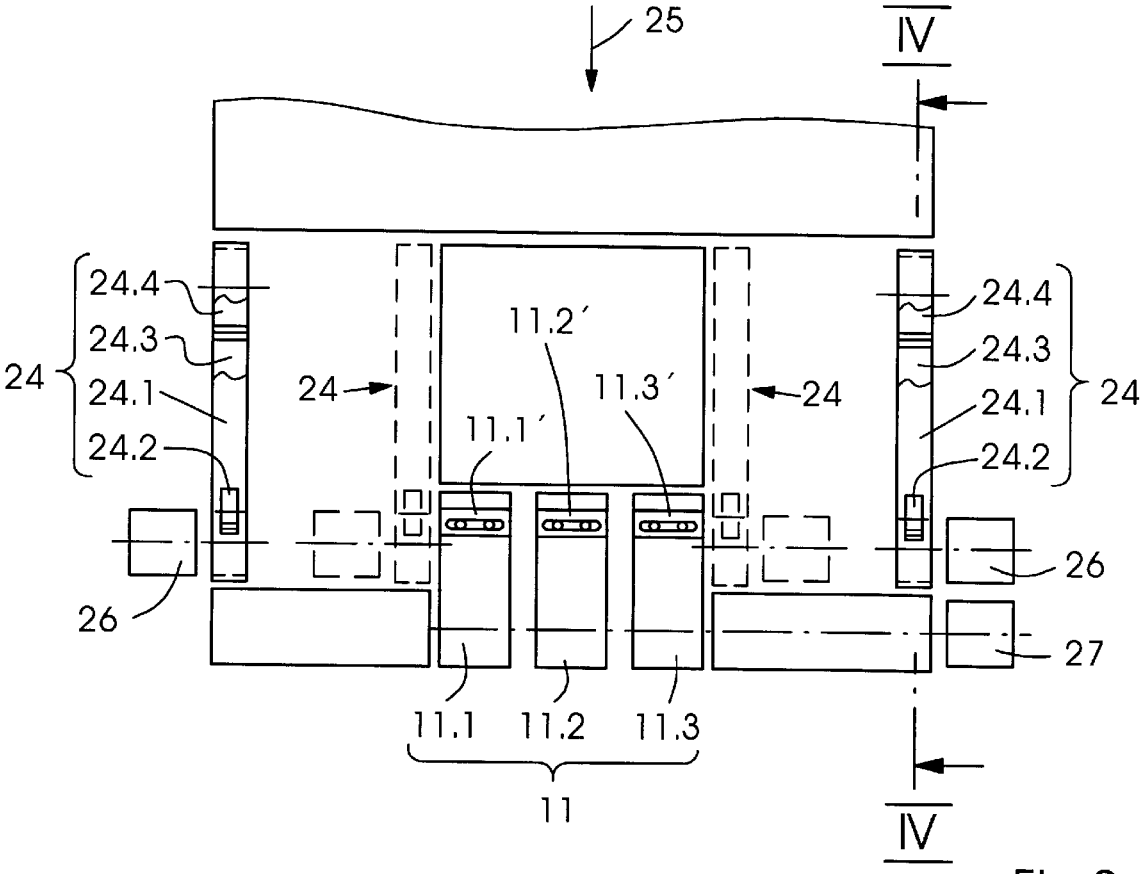
FIG. 2 is an enlarged fragmentary top plan view of FIG. 1 showing an exemplary embodiment of a region including the sheet brake.

A preferred arrangement of the sheet brake 11, on the one hand, and of sheet guides 24, on the other hand, relative to one another can be gathered from the diagrammatic plan view of a delivery region in FIG. 2 which includes the sheet brake 11. In the illustrated embodiment, the sheet guides 24 are formed by guide surfaces 24.1 and cyclically operated hold-downers 24.2 which, in this case, are constructed in the form of rollers. In an operating position of the hold-downers 24.2, the latter press the lateral margins or borders of a respective sheet 3 against the guide surfaces 24.1 and are temporarily displaced into a yielding position, remote from the guide surfaces 24.1, when a leading edge of a respective sheet 3 passes the location at which the hold-downers 24.2 are located in the operating position thereof, i.e., the hold-downers 24.2 are operated cyclically and yield in relation to the gripper systems 9. A mechanism suitable for this purpose can be seen in FIG. 3, which will be discussed in greater detail hereinafter.

In the illustrated configuration according to FIG. 1, the sheet brake 11 includes three synchronously revolving endless braking belts 11.1, 11.2 and 11.3 on which there is formed, respectively, at least one protrusion 11.1', 11.2' and 11.3' which, via at least one bore passing through a respective braking belt 11.1, 11.2, 11.3, is connected to a negative-pressure generator (not illustrated here) in time with the succeeding sheets. For a detailed explanation of this sheet brake 11, reference may be had to German Patent The sheets 3 move towards the sheet brake 11 in the conveying direction represented by the arrow 25, and the braking belts 11.1, 11.2 and 11.3 are driven synchronously, by a motor 27, at variable speed so that, in an operating state, the protrusions 11.1', 11.2', 11.3' are located opposite the underside of one of the sheets 3, in the region of the trailing print-free margin or border thereof, and are at the same speed as the circulating grippers 9.1. In this operating state, the protrusions 11.1', 11.2', 11.3' receive the sheet 3, and the grippers 9.1 release the sheet 3. In particular in this operating state, the respective sheet 3 is guided at the lateral margins thereof, by the sheet guides 24. In the case of the configuration according to FIG. 2, this is realized by the hold-downers 24.2 pressing the sheet 3 against the guide surfaces 24.1. In this case, the hold-downers 24.2 are positioned so that a respective sheet has left the hold-downers 24.2 again when the protrusions 11.1', 11.2', 11.3', after the respective sheet 3 has been received, are decelerated to a depositing speed.

In the case of the configuration according to FIG. 2, moreover, a respective guide surface 24.1 is formed by one strand, respectively, of one revolving belt 24.3, respectively, the strand, running during operation, at the speed of the circulating grippers 9.1, in the conveying direction represented by the arrow 25, while, in the case of a non-illustrated exemplary embodiment, a respective guide surface is formed by a lateral surface of a roller located opposite the respective hold-downer 24.2 and, if appropriate, is freely rotatable.

The rollers 24.4, which have a respective belt 24.3 wrapped around them, and a motor 26, which drives the rollers, are borne, in a manner which is not illustrated, by a respective carriage which can be displaced transversely to the conveying direction represented by the arrow 25, with the result that the sheet guides 24 can be adapted to the mutual spacing between the lateral margins or borders of the sheets 3. This is indicated in FIG. 2 by the position of the sheet guides 24 during a processing of sheets 3 with maximum format, the position being illustrated with solid lines, and a position of the sheet guides 24 during a processing of sheets 3 with minimum format, the latter position being illustrated with broken lines.

In the case of a preferred configuration, the hold-downers 24.2 are formed as freely rotatable rollers by which the lateral margins or borders of the sheets 3 are pressed against guide surfaces 24.1 which support the sheets.

Figure 3:
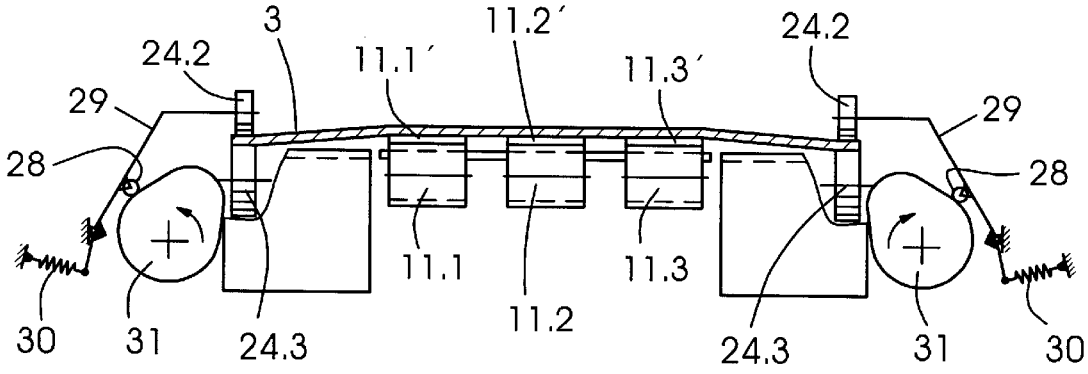
FIG. 3 is an enlarged fragmentary rear elevational view, partly in section, of FIG. 1, as seen in the direction of the arrow III.

FIG. 3 illustrates the aforementioned operating state wherein a sheet 3 has been received at the trailing print-free margin or border by the protrusions 11.1', 11.2' and 11.3'. This operating state is attained after the hold-downers 24.2, which initially yielded in relation to the grippers 9.1, have resumed the operating position thereof, wherein they press the lateral margins or borders of the sheet 3 against the guide surfaces 24.1. The latter are preferably located at a somewhat lower level than the upper sides of the protrusions 11.1', 11.2' located in the operating state. This measure further aids reliable transfer of the sheet 3 to the protrusions 11.1', 11.2', 11.3'. FIG. 3 also illustrates an exemplary embodiment of a mechanism which has already been mentioned and by the aid of which the hold-downers 24.2 yield in relation to the grippers 9.1 (not illustrated in FIG. 3) and then resume the operating position thereof, wherein the hold-downers 24.2 press the respective sheet 3 against the guide surfaces 24.1.

A hold-downer 24.2 preferably formed as a roller, respectively, is held at one end of a respective lever 29, which includes a cam follower 28 and, in this embodiment, has two arms, so that it can be rotated about an axis 3, which is horizontal in the operating position of the hold-downer and is oriented transversely to the conveying direction (note the arrow 25 in FIG. 2). The lever 29 is pivotable in a vertical plane transversely to the conveying direction (arrow 25 according to FIG. 2) and is retained in the operating position by a spring 30, with a given amount of prestressing. The cam follower 28 is likewise preferably formed as a freely rotatably mounted roller and is moved up against a rotating cam 31 which, with pivoting of the lever 29, temporarily displaces the hold-downer 24.2 out of the operating position thereof and into the yielding position thereof whenever the grippers pass the location at which the hold-downers 24.2 assume the operating position thereof.

Figure 4A:
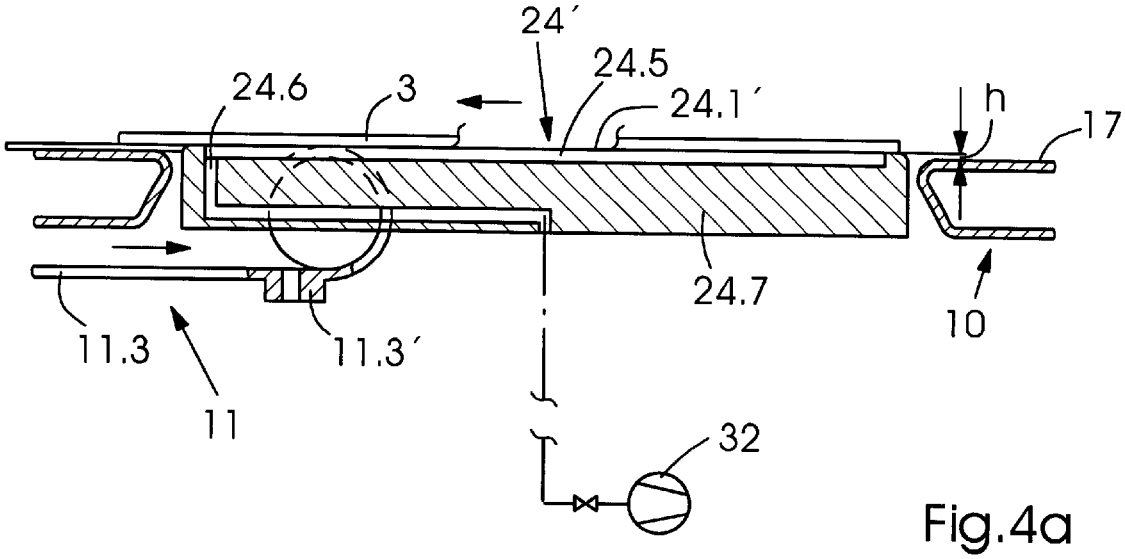
FIG. 4*a* is a sectional view of FIG. 2 taken along the line IV—IV in the direction of the arrows, for the case wherein guide surfaces are provided to remain at a standstill during operation.

The configuration illustrated in FIG. 4*a* provides fixed guide surfaces 24.1' which, in this case, in accordance with the sectional view at hand, extend perpendicularly to the plane of the figure. As with the guide surfaces 24.1 according to FIG. 2, it is also the case with these guide surfaces 24.1' that they extend downline, as viewed in the conveying direction, into a region wherein upline sections of the braking belts 11.1, 11.2, 11.3, which are located between the guide surfaces 24.1', are disposed, with the result that the sheet guides 24' and 24 also reliably fulfill their intended function, namely of guiding a respective sheet 3, as it is transferred to the sheet brake 11, at the lateral margins or borders of the sheets 3, as viewed in the conveying direction.

In the case of a configuration according to FIG. 4*a*, wherein guide surfaces 24.1' are formed on fixed suction bars 24.7, it is indeed possible for this function also to be fulfilled by hold-downers, for example, those of the aforementioned type, and with the aforedescribed operation, however, in the illustrated embodiment of FIG. 4*a*, the operation of pressing the respective sheet 3 against the guide surfaces 24.1' is realized by a pressure difference acting upon the respective sheet 3. Formed, for this purpose, in a respective guide surface 24.1' is a channel 24.5 which is located opposite the respective lateral border or margin of the sheets 3, extends substantially along the length of the guide surface 24.1' in the conveying direction and into which a suction opening 24.6, connectable to a negative-pressure generator 32, terminates, preferably at the downstream end of the channel, as seen in the conveying direction. The pressure difference between the upper and under sides of a sheet 3, which may thus be generated at the sheet 3 drawn over the guide surface 24.1' by a gripper system 9, presses the sheet 3 against the guide surface 24.1'.

In order to ensure that the lateral borders of the sheets 3 are pressed against the guide surface 24.1', which is assigned to one of these respective borders, the guide surface projects a given distance h beyond the sheet-directing surface 17, which is located upline of the guide surface 24.1'. On the other hand, however, as with the guide surfaces 24, the guide surface 24.1' is also located, as can be seen in FIG. 4*a*, beneath that level which the protrusions 11.1', 11.2', 11.3' of the braking belts 9 911.1, 11.2, 11.3 assume when they move in the conveying direction with the revolving braking belts 11.1, 11.2, 11.3.

Figure 4B:
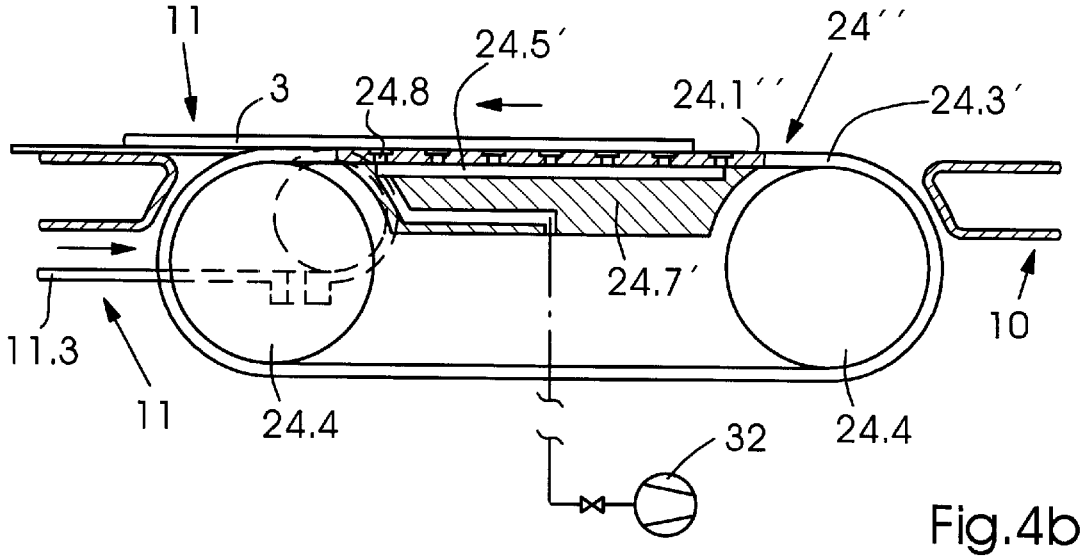

The configuration illustrated in FIG. 4*b* provides a sheet guide 24", in the case of which, once again, guide surfaces

24.1" are formed by strands of endless revolving belts 24.3' running in the conveying direction during operation. In this regard, the strands running in the conveying direction pass over the suction bars 24.7', which are constructed analogously to the suction bars 24.7 according to FIG. 4*a*, and the strands are formed with bores 24.8 which communicate with a channel 24.5' corresponding to the channel 24.5 according to FIG. 4*a* and are connectable to the negative-pressure generator 32, with the result that, on the underside of a lateral border of a sheet 3 that is drawn by the grippers 9.1 of one of the gripper systems 9 over the strand which runs in the conveying direction, it is possible to produce a negative pressure which thus generates, between the upper side and underside of the sheet 3, a pressure difference which presses the sheet 3 against the guide surface 24.1". The pressure difference at the respective sheet 3 is preferably maintained at least until said sheet 3 has been gripped at the trailing print-free border thereof by the protrusions 11.1', 11.2', 11.3'. However, this pressure difference may also be maintained until the sheet 3 gripped by the protrusions 11.1', 11.2', 11.3' is released by corresponding grippers 9.1, in order then to be decelerated to a depositing speed by the sheet brake 11. The respective sheet 3 is preferably subjected to the action of the pressure difference, which is effected cyclically in time with the successive sheets, in that the channel 24.5' is connected continuously to the negative-pressure generator 32 during operation and extends downline as far as a location at which the braking action of the sheet brake 11 takes effect. Moreover, this applies as well to the channel 24.5 of the configuration according to FIG. 4*a*, the channels 24.5 and 24.5' preferably being of such cross sections that they act as throttle paths for a respective suction-air flow prevailing therein.

We claim:

1. A delivery of a sheet-processing printing machine having operationally revolving grippers for transferring processed sheets to a sheet brake in a conveying direction, comprising sheet guides for acting upon lateral borders of the sheets, as viewed in the conveying direction, and for guiding the sheets as they are transferred to the sheet brake.

2. The delivery according to claim 1, wherein said sheet guides are formed with guide surfaces for supporting the lateral borders of the sheets, the lateral borders of the sheets being pressable against said guide surfaces.

3. The delivery according to claim 2, including cyclically operatable hold-downers for pressing the lateral borders of the sheets against said guide surfaces.

4. The delivery according to claim 2, wherein said guide surfaces are operationally at a standstill.

5. The delivery according to claim 2, wherein said guide surfaces are formed by strands of revolving belts running in the conveying direction during operation.

6. The delivery according to claim 2, which comprises suction bars forming said guide surfaces.

7. The delivery according to claim 2, which comprises suction belts, forming said guide surfaces, said suction belts being disposed to circulate during an operation of the delivery.

8. The delivery according to claim 1 wherein said sheet guides are adaptable to mutual spacing between the lateral borders of the sheets.

* * * * *